US008747651B2

(12) United States Patent
Miller et al.

(10) Patent No.: US 8,747,651 B2
(45) Date of Patent: Jun. 10, 2014

(54) HIGH COKING VALUE PITCH

(75) Inventors: Douglas J. Miller, North Olmsted, OH (US); Ching-Feng Chang, Strongsville, OH (US); Irwin C. Lewis, Oberlin, OH (US); Richard T. Lewis, Auburn, OH (US)

(73) Assignee: GrafTech International Holdings Inc., Parma, OH (US)

( * ) Notice: Subject to any disclaimer, the term of this patent is extended or adjusted under 35 U.S.C. 154(b) by 893 days.

(21) Appl. No.: 12/154,430

(22) Filed: May 22, 2008

(65) Prior Publication Data

US 2009/0288983 A1 Nov. 26, 2009

(51) Int. Cl.
*C10C 1/04* (2006.01)

(52) U.S. Cl.
USPC ..... 208/42; 208/4; 208/6; 208/39; 208/41; 208/43

(58) Field of Classification Search
USPC ..... 208/22, 42, 41
See application file for complete search history.

(56) References Cited

U.S. PATENT DOCUMENTS

| | | | | | |
|---|---|---|---|---|---|
| 3,692,663 | A | * | 9/1972 | Ueda | 208/44 |
| 3,928,169 | A | * | 12/1975 | Conroy | 208/22 |
| 3,976,729 | A | | 8/1976 | Lewis et al. | |
| 3,995,014 | A | | 11/1976 | Lewis | |
| 4,017,327 | A | | 4/1977 | Lewis et al. | |
| 4,086,156 | A | * | 4/1978 | Dickakian | 208/41 |
| 4,094,776 | A | * | 6/1978 | Noguchi et al. | 208/22 |
| 4,096,056 | A | | 6/1978 | Haywood et al. | |
| 4,312,742 | A | | 1/1982 | Hayashi | |
| 4,518,483 | A | * | 5/1985 | Dickakian | 208/22 |
| 4,664,774 | A | | 5/1987 | Chu et al. | |
| 4,931,162 | A | | 6/1990 | Romine | |
| 5,259,947 | A | | 11/1993 | Kalback et al. | |
| 5,501,729 | A | | 3/1996 | Lewis et al. | |
| 6,717,020 | B2 | | 4/2004 | Murakami | |
| 6,827,841 | B2 | | 12/2004 | Kiser et al. | |
| 7,033,485 | B2 | | 4/2006 | Saver et al. | |
| 2004/0232041 | A1 | | 11/2004 | Kiser et al. | |

FOREIGN PATENT DOCUMENTS

| | | |
|---|---|---|
| CN | 1832639 A | 9/2006 |
| CN | 1903984 A | 1/2007 |
| WO | 9404727 | 3/1994 |

OTHER PUBLICATIONS

H.G. Franck and J.W. Stadelhefer, "Industrial Aromatic Chemistry" edited by Springer Verlag, (1987), p. 379.

8. L.R. Rudnick et al. "A Study of Alternative Binder Pitch for Carbon Anodes: Characterization of Pitch," (Am. Chem. Sec. Div. of Fuel Chem. 2006, 51).

D.M. Riggs and R.J. Diefendorf, Carbon Conference (1980), p. 326, Rensselaer Polytechnic Institute, Troy, NY, USA.

R.H. Hurt and Y. Hu, Carbon 37, 281 (1999), Division of Engineering, Brown University, Providence, RI, USA.

R.H. Hurt and Y. Hu, Carbon 39, 887 (2001), Division of Engineering, Brown University, Providence, RI, USA.

F. Nazem and I.C. Lewis, Mol. Cryst., Liq. Cryst., vol. 139, p. 195,(1986), Gordon and Breach Science Publishers S. A., USA.

R.T. Lewis, Extended Abstracts for the 12th Biennial Carbon Conference, (1975) p. 215.

W.L. Nelson, "Petroleum Refinery Engineering", Fourth Edition, McGraw-Hill (1958) pp. 674-678.

R.T. Lewis, I.C. Lewis, R.A. Greinke and S.L. Strong, Carbon vol. 25, p. 289 (1987), Printed in Great Britian, Pergamon Journals Ltd.

B.G. Ramsey and M.E. Bier, Journal of Organometallic Chemistry vol. 690, p. 962 (2005), Center for Molecular Analysis, Department of Chemistry, Carnegie Mellon University, Pittsburgh, PA, USA.

E. Clar, "Polycyclic Hydrocarbons", Edited by Academic Press, New York, N.Y. (1964).

I. C. Lewis and L.S. Singer, "Polynuclear Aromatic Compounds", edited by L.E. Eben, American Chemical Society, p. 269 (1988).

W.F. Edwards and M.C. Thies, Abstracts of Carbon 2004, Providence. R.I. (2004).

R.A. Greinke, "Chemistry and Physics of Carbon", Edited by P.A. Thrower, Marcel Dekker, New York, N.Y. vol. 24 (1994).

S. Rand, "Handbook of Composites" vol. 1, 495 (1985), University of Sheffield, United Kingdom.

King, B. 1H and 13C Interpretation tutorial, http://www.wfu.edu/ylwong/chem/nmrc13/c13chemicalshift.html—2003, Wake Forest University.

Joaquin Rodriguez, John W. Tierney, and Irving Wender, Evaluation of a delayed coking process by 1H and 13C n.m.r. spectroscopy: 2. Detailed interpretation of liquid n.m.r. spectra. Fuel 1994, vol. 73, pp. 1870-1875, University of Pittsburgh, Pittsburgh, PA, USA.

http://www.process-nmrcom/liguidanalysis(2).html Analytical liquid-state NMR applications, Process NMR Associates LLC (2003).

G. Wagoner, G. Sprogis, and D. G. Proctor, "Capacitance Bridge Measurement of Thermal Expansion", Carbon 1986 Proceeding, pp. 234-236, Baden-Baden (1986).

H.A. Adams, "Delayed Coking—Practice and Theory" in Introduction to Carbon Technologies, Edited by H. Marsh, E. Heintz and F. Rodrigues-Reinoso, University of Alicante Press (1997), p. 491.

Bhatia, G. et al, Rheological Characteristics of Coal Tar and Petroleum Pitches with and without Additives. Carbon. 1977, vol. 15, p. 219-233.

* cited by examiner

*Primary Examiner* — Prem C Singh
*Assistant Examiner* — Michelle Stein

(57) ABSTRACT

A high coking value pitch prepared from coal tar distillate and has a low softening point and a high carbon value while containing substantially no quinoline insolubles is disclosed. The pitch can be used as an impregnant or binder for producing carbon and graphite articles.

13 Claims, 1 Drawing Sheet

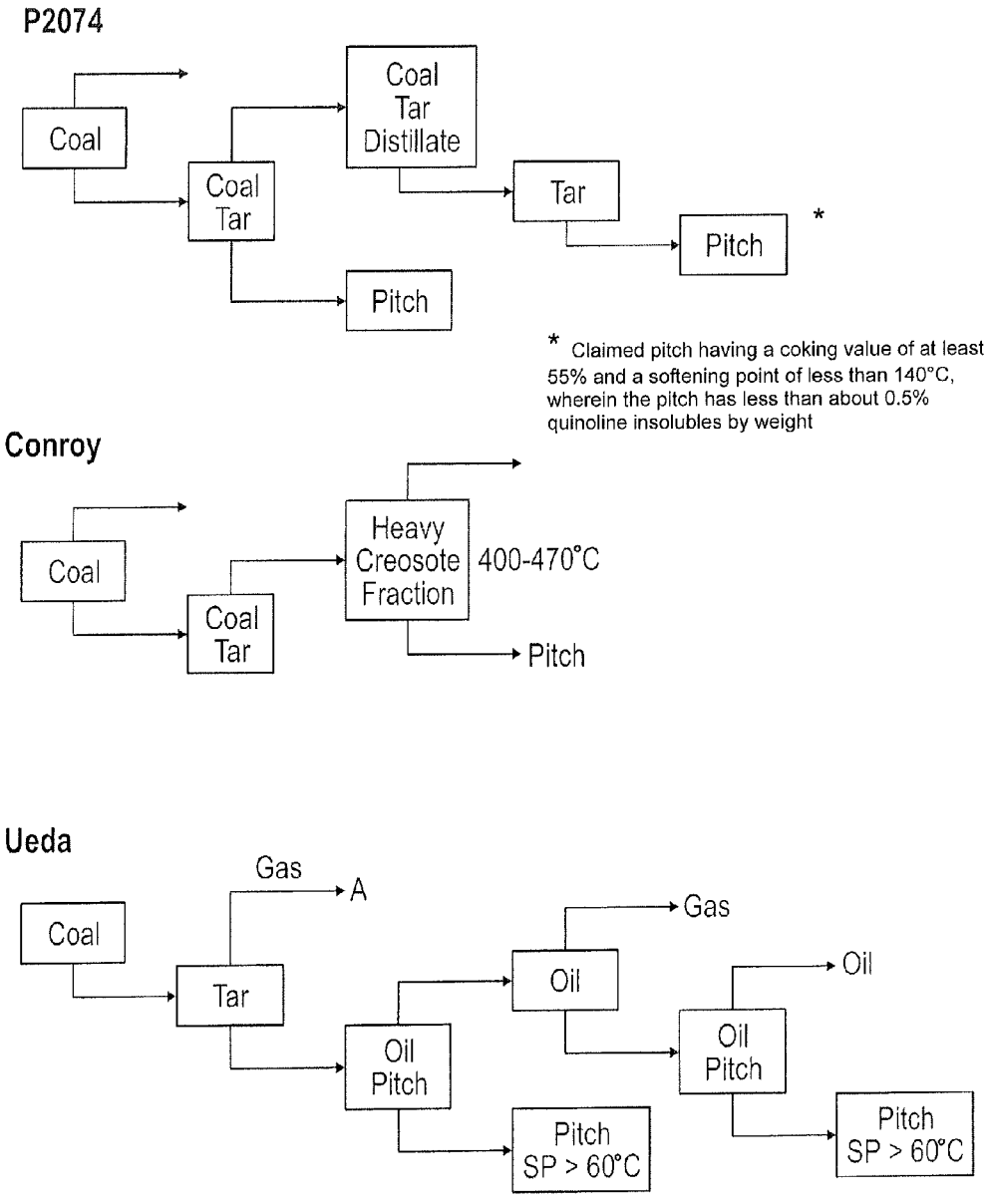
P2074
Coal
Coal Tar
Coal Tar Distillate
Tar
Pitch
Pitch
*
* Claimed pitch having a coking value of at least 55% and a softening point of less than 140°C, wherein the pitch has less than about 0.5% quinoline insolubles by weight
Conroy
Coal
Coal Tar
Heavy Creosote Fraction
400-470°C
Pitch
Ueda
Coal
Tar
Gas
A
Oil Pitch
Pitch SP > 60°C
Oil
Gas
Oil Pitch
Oil
Pitch SP > 60°C

HIGH COKING VALUE PITCH

GOVERNMENT INTERESTS

This invention was made with the support of the U.S. Department of Energy, under Award No. DE-FC26-03NT41874. The Government has certain rights in the invention. However, any opinions, findings, conclusions, or recommendations expressed herein are those of the inventors and do not necessarily reflect the view of the DOE.

BACKGROUND OF THE INVENTION

Technical Field

The present invention relates to a process for producing pitch from coal tar distillate useful as a binder or impregnant in the production of carbon and graphite articles. More particularly, the present invention relates to a pitch with a high Modified Conradson Carbon (MCC) value while also being substantially free of quinoline insolubles. The invention also includes the novel coal tar distillate derived pitch.

Carbon and graphite bodies are porous and many products fabricated from carbon or graphite require the carbon or graphite stock to be impregnated with a suitable impregnant such as a polymer resin or pitch to decrease its porosity and increase strength. Resins are subject to certain inherent disadvantages in that many have high viscosities, low carbon yields, high reactivity, and tend to shrink excessively during carbonization and form a glassy non-graphitizing carbon. For carbonaceous electrodes it is more common to use a pitch as the impregnant. Pitch is a complex mixture of polynuclear aromatics generally derived from the thermal treatment of coal tar or a petroleum tar. At ambient temperature pitch appears solid but is actually a glass-like material which gradually softens to a liquid state with increasing temperature.

Generally, coal tar is created through the destructive distillation of coal into coke, in which coal tar is considered a byproduct of the process. Once the coal tar is obtained through the destructive distillation of coal into coke, the coal tar may be separated into multiple fractions by distillation. The residue of the distillation process is a commercially useful pitch which can be utilized as either impregnating pitch or binder pitch.

During the coal coking operation, infusible solids consisting of coal particles, pyrolytic carbon and inorganic ash are generated and introduced into the coal tar. More specifically, the coal tar which is obtained as the overhead product from the destructive distillation of coal contains infusible carbonaceous solids which are formed either by the gas phase carbonization or as a result of coal carryover. These materials, known as Quinoline Insolubles (QI), then concentrate in the distillation of tar to pitch. The QI solids prevent penetration of the molten pitch into the pores of the carbon body during impregnation. They also serve to inhibit the development of large domain mesophase pitch during carbonization of the pitch, thus degrading the properties of the final graphite product.

For use as impregnants, the QI content of the pitch should be low, typically less than 2%, and preferably less than 1%. To be practically useful as impregnants the pitch softening points are kept at between 90-120° C. Higher softening point pitches require excessive temperatures for impregnation and have limited application as an impregnant pitch.

State of the art commercial pitches with these properties have carbon yields ranging from 40-50%. It is desirable to maximize the carbon yield for an impregnating pitch, but this can only be accomplished by raising the softening point to excessive levels.

As shown in "Industrial Aromatic Chemistry," by H. G. Franck and J. W. Stadelhefer, edited by Springer Verlag, (1987), p. 379, a typical coal tar impregnating pitch for graphite electrodes has a 2% QI content and a Modified Conradson Carbon (MCC) value of 38%.

As shown (U.S. Pat. No. 6,827,841) to M. D. Kiser et al., petroleum pitches suitable for impregnation with softening points of 118 to 124° C. have MCC values of about 49%. Low QI pitches with softening points of 112° C. were also prepared by L. R. Rudnick et al. (Am. Chem. Sec. Div. of Fuel Chem. 2006, 51) and had carbon yields of 47-51%.

For binder pitches, the carbon yield can be increased by incorporating more QI into the pitch. For example, as shown in Industrial Aromatic Chemistry, typical properties of a binder pitch for electrodes are 10% QI and 56% carbon yield. However, as pointed out previously, the high QI level reduces the graphitizability of the pitch-derived carbon and would raise the electrical resistivity of the graphite electrode.

Generally, impregnating pitches have coking values no higher than 40-50% based on a MCC test. Typically, impregnating pitches are solid at room temperature and must be preheated to a high temperature to transform them to a low viscosity liquid suitable for impregnation. To be commercially useful as an impregnant for typical carbon and graphite electrodes, the pitch should have a softening point no greater than 140° C. It is also conventional to preheat the carbon or graphite electrode stock to an elevated temperature before adding the pitch impregnant. The electrode is then cooled to solidify the impregnant within the graphite electrode. After the pitch is impregnated into the carbon or graphite body, it is normally rebaked to carbonize the impregnant.

A variety of characteristics is used to describe the different types of pitches available for impregnation of a graphite or carbon article. These characteristics include a pitch's coking value measured by the MCC method, its percentage of insoluble material in quinoline, as well as the softening point of the coal tar pitch. Notably, the softening point is measured by the ASTM standard D3104 method and is generally defined as the temperature at which a particular coal tar pitch begins to soften under the specified test conditions. The MCC value is determined using standard procedure ASTM D-2416 and the QI content is measured by method ASTM D-2318.

A variety of different processes have been developed in order to create pitches with varying characteristics for different applications. For example, in Haywood et al., U.S. Pat. No. 4,096,056, a process is disclosed for converting petroleum into pitch wherein a pitch is created with a softening point of about 135° C. Additionally, the '056 patent includes disclosure of an oxygen treatment.

Kiser et al. (U.S. Pat. No. 6,827,841) uses a biodiesel material as a blend component for producing pitch.

In U.S. Pat. No. 4,931,162, Romine described the preparation of a clean pitch suitable for the manufacture of carbon artifacts obtained by distilling from an aromatic feedstock a distillate material free from mesophase forming resins. The distillate is heated to obtain a heat soaked distillate free from mesophase but containing mesophase forming resins. The heat soaked distillate is further heated with inert gas sparging to convert it to mesophase pitch suitable for manufacturing carbon fibers In U.S. Patent Application Publication No. 20040232041, Kiser et al. describes the use of hydrotreatment to produce a low sulfur pitch with a softening point of 121° C. and Modified Conradson Carbon yield of 51%.

Lewis (U.S. Pat. No. 5,501,729) claims a pitch based impregnant for a carbon or graphite body and a method of impregnation. Specifically, the '729 patent describes the admixture of a pitch with a polymerizable liquid which is thermosetting at a relatively low temperature.

In Saver et al., U.S. Pat. No. 7,033,485, a method of using evaporative distillation is described for producing a high softening point coal tar pitch which is substantially quinoline insoluble free. The method claims the use of either a coal tar pitch, petroleum pitch, or a combination for use as the feedstock for the evaporative distillation.

Unfortunately, coal tar pitches produced by the prior art processes do not have a good combination of properties for impregnating carbon and graphite electrodes. The pitches generally do not have a sufficient carbon yield nor do they have a low enough softening point while being substantially quinoline insoluble free. In addition, the use of petroleum for creating pitch is becoming more disadvantageous as the price of petroleum continues to rise.

What is desired therefore is a high coking value pitch created from coal tar which is substantially free of quinoline insolubles while possessing a sufficiently low softening point. Indeed a combination of characteristics including a coking value higher than contemplated in the prior art as well as a sufficiently low softening point have been found to be necessary for the use of a coal tar-derived pitch for impregnating a graphite or carbon article. Also desired is a process for creating such a pitch material.

BRIEF DESCRIPTION

Disclosed herein is a coal tar distillate derived pitch with the unique combination of characteristics making it useful for impregnating graphite or carbon articles. The disclosed pitch exhibits a combination of quinoline insolubles content, softening point, and carbon yield characteristics not heretofore seen. In addition, the specific process for producing the mesophase pitch from a coal tar distillate feedstock utilizes unique process conditions and thus provides an isotropic pitch with a softening point no greater than 90 to about 140° C.

More particularly, the inventive carbon pitch has a carbon yield measured by the MCC method of from about 55% to about 70%. When compared to other pitches substantially free of quinoline insolubles, this is a very high relative MCC value and thus, is even more suitable for use in impregnating graphite and carbon articles. Comparatively, petroleum pitch likely has MCC values of from about 40% to about 55% at similar softening point of from about 90 to 140° C. Furthermore, the high coking values obtained with the disclosed process of producing the pitch are more comparable to high quinoline insoluble coal tar binder pitches though notably it is substantially quinoline insoluble free.

In one embodiment, the pitch is created by converting a high boiling range coal tar distillate to an isotropic pitch with a softening point of from about 90° C. to about 140° C. The procedure for the conversion of the coal tar distillate to the pitch involves a heat treatment (at a temperature of at least about 350° C. (in one embodiment the heat treatment is at a temperature of at least 350° C. to less than 440° C.)) of the coal tar distillate under pressure of from about 50 psig (0.345 MPa(g)) to about 120 psig (0.83 MPa(g)) to produce tar. Heat treatment can, in at least one embodiment of the invention, polymerize the relatively low molecular weight components in the high boiling distillate into larger molecules of the type found in pitches. The pressure employed is sufficient to keep the bulk of the distillate in a liquid state during the heat treatment and prevent volatilization of the distillate components. Subsequently, the resultant tar from the pressurized heat treatment is distilled using either vacuum or an inert gas sparge to achieve a solids-free pitch with an appropriate softening point and relatively high coking yield properties.

Advantageously, to produce the novel pitch, the high boiling range coal tar distillate is converted into tar with the use of a heat treatment of at least 400° C. under a pressure of from about 50 psig (0.345 MPa(g)) to about 120 psig (0.83 MPa (g)). This is followed by a distillation to produce a pitch with a coking value of from about 55% to about 70% and a softening point of from about 90° C. to about 140° C.

An object of the invention, therefore, is a coal tar distillate derived pitch possessing both a softening point of from about 90° C. to about 140° C. and a coking yield of from about 55% to about 70%.

Another object of the invention is a pitch having characteristics which enable it to be employed for impregnating either graphite articles or carbon articles.

Still another object of the invention is a process for creating a beneficial pitch having a combination of characteristics which enable it to be used as a binder pitch for producing graphite or carbon articles. For instance, in one embodiment, the inventive pitch has less than about 15% by weight quinoline insolubles. In another, more preferred, embodiment, the concentration of quinoline insolubles in the pitch comprises less than about 5%. In yet another embodiment, the pitch has a concentration of quinoline insolubles that comprises less than about 2%.

Yet another object of the invention is a process for creating a novel pitch which includes the conversion of a high boiling range coal tar distillate to a pitch under both a heat treating and pressurization step.

These aspects and others that will become apparent to the artisan upon review of the following description can be accomplished by providing a high boiling range coal tar distillate and converting the coal tar distillate to a pitch in a procedure involving a heat treatment of the coal tar distillate under pressure of from about 50 psig (0.345 MPa(g)) to about 120 psig (0.83 MPa(g)) followed by distillation of the resultant tar. In a preferred embodiment, the resulting pitch has an MCC carbon yield of from about 55% to about 70% and a softening point of from about 90° C. to about 140° C., preferably 110° C.-130° C.

The unique pitch is substantially free of quinoline insolubles but possesses an MCC value similar to the value associated with a higher quinoline insoluble-containing coal tar binder pitch having a similar softening point. Advantageously, the novel pitch is substantially quinoline insoluble free and thus does not contain substantial solid residues which would otherwise adversely affect the behavior of the coal tar distillate derived pitch.

It is to be understood that both the foregoing general description and the following detailed description provide embodiments of the invention and are intended to provide an overview or framework of understanding as to the nature and character of the invention as it is claimed.

DETAILED DESCRIPTION OF THE PREFERRED EMBODIMENT

The coal tar distillate used as a starting material for the creation of the substantially solids-free and high coking value pitch through the disclosed process is obtained through the distillation of coal tar. Coal tar is derived from the coking process used to produce metallurgical coke from coal. Moreover, the production of coal tar from coal is a high-temperature destructive distillation process by which bituminous coal is transformed into both coke and coal tar.

The coal tar which is obtained as the overhead product from the destructive distillation of coal contains infusible carbonaceous solids which are formed either by gas phase carbonization or as a result of coal carryover. Furthermore, in subsequent distillations, where coal tar undergoes distillation, alkaline materials may be added to the coal tar to preclude corrosion.

In the distillation of coal tars, the coal tar is separated into at least two products, the heavy residual product being the coal tar pitch residue with the overhead product being the coal tar distillate. In one embodiment of the distillation of coal tar, multiple distillation columns are utilized for the separation of the coal tar into coal tar pitch and several coal tar distillates with different boiling ranges.

The resulting coal tar pitch residue and coal tar distillates can have various boiling range characteristics dependent upon the distillation process, the process conditions, as well as the starting coal tar material. The boiling range of the coal tar distillate is related to the molecular weight composition with the higher boiling distillate fractions containing a higher percentage of high molecular weight components.

Similar to aromatic residues created through the cracking of a petroleum feedstock, the coal tar distillates derived from the distillation of coal tar contain a high proportion of polycondensed aromatics. Specifically, the coal tar distillate has an elemental carbon weight percentage of from about 85% to about 95% and an elemental hydrogen weight percentage of from about 3% to about 8%. Other elemental components of coal tar distillate include but are not limited to nitrogen, oxygen, and sulfur.

The first step in producing the disclosed pitch is the selection of a coal tar distillate with a relatively high boiling range. Coal tar distillates with a high temperature boiling range could include such materials as light creosote oil, with a boiling range typically beginning at about 270° C. to 315° C., middle creosote oil, with a boiling range typically beginning between about 315° C. and 355° C., and heavy creosote oil, with a boiling range typically beginning at about 355° C. The boiling range at atmospheric pressure of the high boiling range coal tar distillate should begin from at least about 270° C., preferably from about 315° C., and more preferably from around 355° C.

The selected high boiling range coal tar distillate should be substantially free of quinoline insolubles which can limit its utility as an impregnant as well as inhibit the development of large-domained mesophase. As known in the art, quinoline insolubles are typically defined as solid particles existing in coal tar throughout the process of carbonization or coking and can impart undesirable qualities on the performance of pitches containing these particles. The insolubles can include coal particles, fine carbonaceous solids of less than about 1 micron in diameter and inorganic ash. As such, optionally coal tar distillate containing substantially no quinoline insolubles may be utilized for the disclosed process and the coal tar distillate should contain less than about 0.5% quinoline insolubles by weight, preferably less than 0.1% by weight.

After selecting a relatively high boiling range coal tar distillate (e.g. a boiling range beginning from at least 270° C., in some instances a range beginning at about 315° C., or even beginning at 355° C.) with substantially no quinoline insolubles, the coal tar distillate undergoes a conversion step in which both pressure and temperature are applied. In one example, the distillate is a heavy creosote oil with an initial boiling range beginning at greater than 355° C. The distillate materials are held at a temperature of from about 400° C. to about 525° C., preferably about 410° C. to about 475° C. with the temperature more preferably around 420° C. to about 440° C. Once the aforementioned temperature of the distillate material is achieved, the coal tar distillate is held at that temperature for about 1 hour to about 7 hours, preferably about 3 hours to about 7 hours, and more preferably about 5 hours. Additionally, during this heat treatment of the coal tar distillate material, the process includes a relatively high system pressure ranging from about 50 psig (0.345 MPa(g)) to about 120 psig (0.83 MPa(g)). Preferably, the system pressure is maintained at about 70 psig (0.48 MPa(g)) to about 100 psig (0.69 MPa(g)). The heating is not limited to any particular rate, although one rate found effective is a rate of increasing the temperature from about 1° C. per hour to about 10° C. per hour.

Alternatively, the process of the present invention can be carried out as a continuous process, whereby the coal tar distillate is processed through a flow-through apparatus and subjected to higher temperatures (on the order of at least about 400° C., and more preferably from about 450° C. to about 525° C. or higher) and higher pressures consistent with the requirements needed to polymerize the distillate into a tar.

This heat treatment of the coal tar distillate under a relatively high pressure is followed by the distillation of the resultant material using either vacuum or inert gas sparge. The distillation residue consists of isotropic pitch suitable for use as an impregnant or binder. The light distillation product consists of lighter molecular weight hydrocarbons which can be collected and utilized for a variety of other applications.

The resulting pitch has a unique combination of both a relatively low softening point, suitable for use as a commercial impregnant or binder in the production of carbon and graphite articles, and a high carbon yield. The softening point or softening temperature of a pitch, is related to its molecular weight constitution; the presence of a large amount of high molecular weight components generally tends to raise the softening temperature. It is a common practice in the art to characterize in part a pitch by its softening point.

Generally, there are several methods for determining the softening temperature and the temperatures measured by these different methods vary somewhat from each other.

The Mettler softening point procedure is widely accepted as the standard for evaluating pitches. Specifically, the Mettler softening point procedure includes taking small samples of the pitch and loading the samples into cups which are placed on the Mettler Softening Point apparatus. The samples are then heated at about 2° C. per minute until a sample viscosity of about 10,000 poise is obtained. The procedure is described in ASTM D-3461.

Generally, as known in the art, the coking value is measured by the MCC method which measures the weight percent coke derived from the pitch after being subjected to a high temperature carbonization heat treatment. A high coking value is advantageous in forming impregnants for carbon and graphite articles as well as for use as a binder in creating the carbon and graphite articles. A higher coking value corresponds to a higher amount of coke present in the graphite or carbon electrode. This higher amount of coke in the final carbon articles is an advantage as in the case of creating a graphite electrode, since it results in higher product density and strength. A higher carbon yield is also an advantage from a processing standpoint, since it can reduce the number of cycles used during the impregnation process. The MCC value of a pitch is measured using the standard procedure ASTM D-2416.

The pitch created through the aforementioned process should have a softening point of from about 90° C. to about 140° C. and an MCC value of from about 55% to about 70%.

The following example will serve to illustrate the invention but is not intended to limit the scope of the invention in any way.

EXAMPLE

A high boiling range coal tar distillate (known as heavy creosote oil) with a boiling range beginning at greater than 355° C. is heat treated at between 430° C. and 435° C. for five hours in a reactor pressurized with a non-oxidizing gas to a pressure of about 100 psig (0.69 MPa(g)). The resultant tar is collected from the reactor and subsequently distilled with an inert gas sparge to create an isotropic pitch. The softening point of the pitch is determined to be about 128° C. The MCC method measures a coking value of about 61.4% for the pitch. For comparison purposes, an Ashland petroleum pitch containing substantially no quinoline insolubles would likely have a MCC value of about 52% to about 54% at a similar softening point of about 128° C.

The pitch derived from the high boiling range coal tar distillate would likely be an excellent candidate as an impregnant or possibly as a binder for both general carbon and graphite production. As described above, the pressurized heat treatment and distillation process using a high boiling range coal tar distillate precursor produces a unique molecular weight pitch composition which possesses a good combination of softening point and carbon yield properties not heretofore seen in the prior art.

Accordingly, by the practice of the disclosed process, a pitch having heretofore unrecognized characteristics is prepared. These pitches exhibit exceptionally favorable characteristics of a high coking value as well as low softening point while containing substantially no quinoline insolubles.

Furthermore, the present invention includes the method of converting a high boiling range coal tar distillate into a pitch having the characteristics of both a low softening point and high carbon yield while possessing less than about 0.5% quinoline insolubles by weight.

The disclosures of all cited patents and publications referred to in this application are incorporated herein by reference in their entirety.

The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A method of creating a pitch, comprising:

a) heating a coal tar distillate having a boiling range beginning from at least 270° C. under pressure to obtain a tar;

b) distilling the tar to create a pitch having a coking value of at least 55% and a softening point of at least 110° C. and less than 140° C., wherein the pitch has less than about 0.5% quinoline insolubles by weight.

2. The method of claim 1 wherein the boiling range begins at about 315° C.

3. The method of claim 1 wherein the boiling range begins at about 355° C.

4. The method of claim 1 wherein the pressure of step a) is of from about 0.345 MPa(g) to about 0.83 MPa(g).

5. The method of claim 4 wherein the pressure is up to 0.69 MPa(g).

6. The method of claim 1 wherein the coal tar distillate of step a) is heated to a temperature of from about 400° C. to about 525° C.

7. The method of claim 6 further comprising heating the coal tar distillate of step a) at a rate of from about 1° C. per hour to about 10° C. per hour.

8. The method of claim 6 further comprising holding the temperature of step a) for about 1 hour to about 7 hours.

9. The method of claim 1 wherein the coking value of step b) comprises a Modified Conradson Carbon coking value of from about 55% to about 70%.

10. A continuous method of creating a pitch, comprising:

a) heating a coal tar distillate having a boiling range beginning at 270° C. to a temperature of at least about 450° C. under pressure while the coal tar distillate is flowing through a reactor, to obtain a tar;

b) distilling the tar to create pitch, having a coking value of at least 55% and a softening point of at least 110° C. and less than 140° C., wherein the pitch has less than about 0.5% quinoline insolubles by weight.

11. The method of claim 10 further comprising the coal tar distillate having a boiling range beginning from about 315° C.

12. The method of claim 10 further comprising the coal tar distillate having a boiling range beginning from about 355° C.

13. The method of claim 10 wherein the coking value of step b) comprises a Modified Conradson Carbon coking value of from about 55% to about 70%.

* * * * *

UNITED STATES PATENT AND TRADEMARK OFFICE

CERTIFICATE OF CORRECTION

PATENT NO. : 8,747,651 B2
APPLICATION NO. : 12/154430
DATED : June 10, 2014
INVENTOR(S) : Douglas J. Miller et al.

It is certified that error appears in the above-identified patent and that said Letters Patent is hereby corrected as shown below:

Delete Title page and replace with new Title page. (Attached)

In the Drawings

Delete the drawing sheet.

Signed and Sealed this
Twenty-first Day of July, 2015

Michelle K. Lee

Michelle K. Lee
*Director of the United States Patent and Trademark Office*

(12) United States Patent
Miller et al.

(10) Patent No.: US 8,747,651 B2
(45) Date of Patent: Jun. 10, 2014

(54) HIGH COKING VALUE PITCH

(75) Inventors: Douglas J. Miller, North Olmsted, OH (US); Ching-Feng Chang, Strongsville, OH (US); Irwin C. Lewis, Oberlin, OH (US); Richard T. Lewis, Auburn, OH (US)

(73) Assignee: GrafTech International Holdings Inc., Parma, OH (US)

( * ) Notice: Subject to any disclaimer, the term of this patent is extended or adjusted under 35 U.S.C. 154(b) by 893 days.

(21) Appl. No.: 12/154,430

(22) Filed: May 22, 2008

(65) Prior Publication Data

US 2009/0288983 A1 Nov. 26, 2009

(51) Int. Cl.
*C10C 1/04* (2006.01)

(52) U.S. Cl.
USPC ..... 208/42; 208/4; 208/6; 208/39; 208/41; 208/43

(58) Field of Classification Search
USPC ..... 208/22, 42, 41
See application file for complete search history.

(56) References Cited

U.S. PATENT DOCUMENTS

| | | | | |
|---|---|---|---|---|
| 3,692,663 | A * | 9/1972 | Ueda | 208/44 |
| 3,928,169 | A * | 12/1975 | Conroy | 208/22 |
| 3,976,729 | A | 8/1976 | Lewis et al. | |
| 3,995,014 | A | 11/1976 | Lewis | |
| 4,017,327 | A | 4/1977 | Lewis et al. | |
| 4,086,156 | A * | 4/1978 | Dickakian | 208/41 |
| 4,094,776 | A * | 6/1978 | Noguchi et al. | 208/22 |
| 4,096,056 | A | 6/1978 | Haywood et al. | |
| 4,312,742 | A | 1/1982 | Hayashi | |
| 4,518,483 | A * | 5/1985 | Dickakian | 208/22 |
| 4,664,774 | A | 5/1987 | Chu et al. | |
| 4,931,162 | A | 6/1990 | Romine | |
| 5,259,947 | A | 11/1993 | Kalback et al. | |
| 5,501,729 | A | 3/1996 | Lewis et al. | |
| 6,717,020 | B2 | 4/2004 | Murakami | |
| 6,827,841 | B2 | 12/2004 | Kiser et al. | |
| 7,033,485 | B2 | 4/2006 | Saver et al. | |
| 2004/0232041 | A1 | 11/2004 | Kiser et al. | |

FOREIGN PATENT DOCUMENTS

| | | |
|---|---|---|
| CN | 1832639 A | 9/2006 |
| CN | 1903984 A | 1/2007 |
| WO | 9404727 | 3/1994 |

OTHER PUBLICATIONS

H.G. Franck and J.W. Stadelhefer, "Industrial Aromatic Chemistry" edited by Springer Verlag, (1987), p. 379.

8. L.R. Rudnick et al. "A Study of Alternative Binder Pitch for Carbon Anodes: Characterization of Pitch," (Am. Chem. Sec. Div. of Fuel Chem. 2006, 51).

D.M. Riggs and R.J. Diefendorf, Carbon Conference (1980), p. 326, Rensselaer Polytechnic Institute, Troy, NY, USA.

R.H. Hurt and Y. Hu, Carbon 37, 281 (1999), Division of Engineering, Brown University, Providence, RI, USA.

R.H. Hurt and Y. Hu, Carbon 39, 887 (2001), Division of Engineering, Brown University, Providence, RI, USA.

F. Nazem and I.C. Lewis, Mol. Cryst., Liq. Cryst., vol. 139, p. 195,(1986), Gordon and Breach Science Publishers S. A., USA.

R.T. Lewis, Extended Abstracts for the 12th Biennial Carbon Conference, (1975) p. 215.

W.L. Nelson, "Petroleum Refinery Engineering", Fourth Edition, McGraw-Hill (1958) pp. 674-678.

R.T. Lewis, I.C. Lewis, R.A. Greinke and S.L. Strong, Carbon vol. 25, p. 289 (1987), Printed in Great Britian, Pergamon Journals Ltd.

B.G. Ramsey and M.E. Bier, Journal of Organometallic Chemistry vol. 690, p. 962 (2005), Center for Molecular Analysis, Department of Chemistry, Carnegie Mellon University, Pittsburgh, PA, USA.

E. Clar, "Polycyclic Hydrocarbons", Edited by Academic Press, New York, N.Y. (1964).

I. C. Lewis and L.S. Singer, "Polynuclear Aromatic Compounds", edited by L.E. Eben, American Chemical Society, p. 269 (1988).

W.F. Edwards and M.C. Thies, Abstracts of Carbon 2004, Providence. R.I. (2004).

R.A. Greinke, "Chemistry and Physics of Carbon", Edited by P.A. Thrower, Marcel Dekker, New York, N.Y. vol. 24 (1994).

S. Rand, "Handbook of Composites" vol. 1, 495 (1985), University of Sheffield, United Kingdom.

King, B. 1H and 13C Interpretation tutorial, http://www.wfu.edu/ylwong/chem/nmrc13/c13chemicalshift.html—2003, Wake Forest University.

Joaquin Rodriguez, John W. Tierney, and Irving Wender, Evaluation of a delayed coking process by 1H and 13C n.m.r. spectroscopy: 2. Detailed interpretation of liquid n.m.r. spectra. Fuel 1994, vol. 73, pp. 1870-1875, University of Pittsburgh, Pittsburgh, PA, USA.

http://www.process-nmr.com/liquidanalysis(2).html Analytical liquid-state NMR applications, Process NMR Associates LLC (2003).

G. Wagoner, G. Sprogis, and D. G. Proctor, "Capacitance Bridge Measurement of Thermal Expansion", Carbon 1986 Proceeding, pp. 234-236, Baden-Baden (1986).

H.A. Adams, "Delayed Coking—Practice and Theory" in Introduction to Carbon Technologies, Edited by H. Marsh, E. Heintz and F. Rodrigues-Reinoso, University of Alicante Press (1997), p. 491.

Bhatia, G. et al, Rheological Characteristics of Coal Tar and Petroleum Pitches with and without Additives. Carbon. 1977, vol. 15, p. 219-233.

* cited by examiner

*Primary Examiner* — Prem C Singh
*Assistant Examiner* — Michelle Stein

(57) ABSTRACT

A high coking value pitch prepared from coal tar distillate and has a low softening point and a high carbon value while containing substantially no quinoline insolubles is disclosed. The pitch can be used as an impregnant or binder for producing carbon and graphite articles.

13 Claims